United States Patent [19]

Kondo

[11] Patent Number: 4,472,991

[45] Date of Patent: Sep. 25, 1984

[54] KEY DEPRESSION NUMBER PROCESSING SYSTEM FOR KEYBOARD CIRCUIT

[75] Inventor: Nobuaki Kondo, Omiya, Japan

[73] Assignee: Kabushiki Kaisha Kawai Gakki Seisakusho, Japan

[21] Appl. No.: 418,999

[22] Filed: Sep. 16, 1982

[30] Foreign Application Priority Data

Sep. 22, 1981 [JP] Japan ..... 56-150214

[51] Int. Cl.[3] ..... G10H 1/00

[52] U.S. Cl. ..... 84/1.01; 84/DIG. 2

[58] Field of Search ..... 84/DIG. 2, 1.03, 1.24, 84/1.01

[56] References Cited

U.S. PATENT DOCUMENTS 4,122,744 10/1978 Uetrecht ..... 84/1.25

4,287,802 9/1981 Imamura et al. ..... 84/1.01

*Primary Examiner*—Forester W. Isen

*Attorney, Agent, or Firm*—McGlew and Tuttle

[57] ABSTRACT

Key switches of a keyboard circuit are scanned by a counter which starts at a lower or upper limit value that is preset in the counter by a signal which also reverses the counting direction data from the counter, is provided to a first circuit having preset therein the number of preferential low-pitched or high-pitched tones to be produced and a second circuit having preset therein a maximal number of tones to be produced. In the case where the number of preferential low-pitched tones is preset in the first circuit, and when the number of tones based on the data from the counter reaches the preset number, the direction of counting of the counter is reversed by the signal to cause the counter count down starting with the preset upper limit value. In the case where the number of preferential high-pitched tone productions is preset in the first circuit, and when reaching the preset number, the direction of counting of the counter is inverted to cause it to count up from the preset lower limit value. When the number of simultaneous key depressions exceeds the maximal number of tones allowed by the second circuit, the processing causes middle-pitched tones to be eliminated.

4 Claims, 3 Drawing Figures

KEY DEPRESSION NUMBER PROCESSING SYSTEM FOR KEYBOARD CIRCUIT

BACKGROUND OF THE INVENTION

1. Field of the Invention

The present invention relates to a key depression number processing system for a keyboard circuit which is limited in its maximal number of tones that can be produced. In the case where the number of simultaneous key depressions is larger than the maximal number of tones that can be produced, high-pitched and low-pitched tones are preferentially produced omitting intermediate tones, thereby making the limitation on the maximal number of tones unnoticeable.

2. Description of the Prior Art

In conventional key depression number processing systems for a digital keyboard circuit, there have been employed such techniques as "preferential tone production of earlier depressend keys", "preferential tone production of later depressed keys", "preferential high-pitched tone production", "preferential low-pitched tone production" and so forth, in the case where the number of simultaneous key depressions is larger than a maximal number of tones that can be produced. With any of these systems, however, when keys are simultaneously depressed in excess of the limited maximal tones, unnatural sounding tones inevitably resulted.

It is known that human ears are sensitive to the addition of low-pitched or high-pitched sounds to a group of sounds being produced but not so sensitive to the addition or subtraction of intermediate sounds. The present invention is based on an idea of preferentially producing low-pitched and high-pitched depressed key tones omitting the intermediate depressed key tones in the case where the number of simultaneous key depressions is larger than the maximal number of tones that can be produced.

SUMMARY OF THE INVENTION

It is an object of the present invention to provide a key depression number processing system for a keyboard circuit which is adapted so that when keys are simultaneously depressed in excess of a limited maximal number of tones which can be produced, the limitation is made unnoticeable.

Briefly stated, according to the present invention, key switches of a keyboard circuit are scanned by a counter adapted for starting its counting operation with a lower or upper limit value that is preset by a reversal of a counting-direction signal. Data available from the counter is provided to first means having preset therein the number of preferential low-pitched or high-pitched tone productions and second means having preset therein a maximal number of tones to be produced or which are allowed. In the case where the number of preferential low-pitched tones to be produced is preset in the first means, when the number of tones to be produced based on the data from the counter, reaches the preset number, the direction of counting of the counter is inverted to cause it to perform its counting operation starting with the preset lower limit value in a reverse direction, thereby to process the number of simultaneous key depressions. In the case where the number of preferential high-pitched tones to be produced is preset in the first means, when the number of tones based on the data from the counter reaches the preset number, the direction of counting of the counter is reversed to cause it to perform its counting operation starting with the preset upper limit value in a reverse direction, thereby to process the number of simultaneous key depressions. When the number of simultaneous key depressions exceeds the maximal number of tones allowed, which number is preset in the second means, the processing is completed when the maximal number of tones which is preset in the second means is reached. With such a method, low-pitched and high-pitched depressed key tones are preferenctially produced while omitting the intermediate depressed key tones, and this is not so offensive to the ear and permits smooth processing of a large number of simultaneous key depressions.

DESCRIPTION OF THE PREFERRED EMBODIMENTS

Figure 1A:
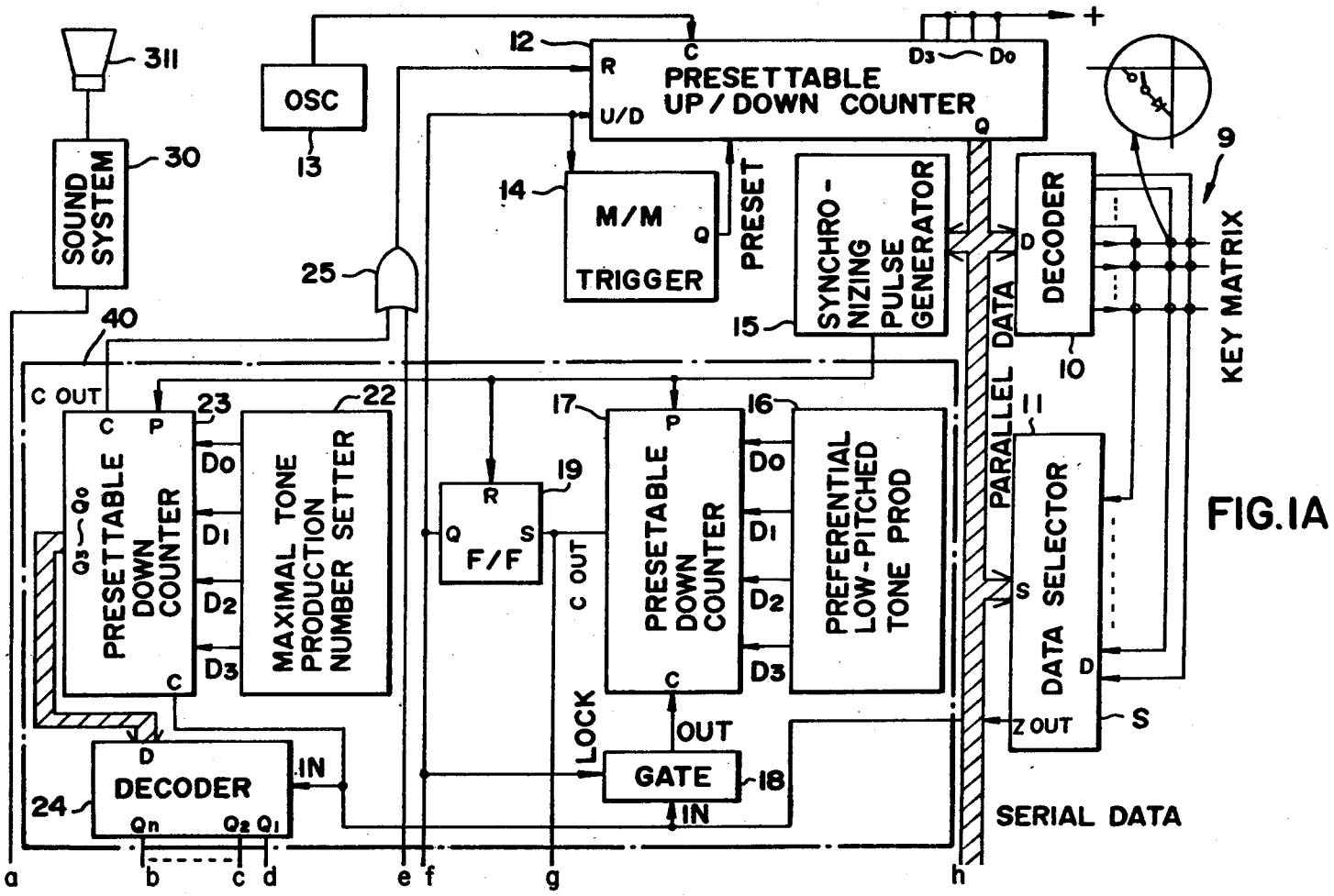
FIGS. 1A and 1B are block diagrams which together are explanatory of the arrangement of an embodiment of the present invention.
Figure 1B:
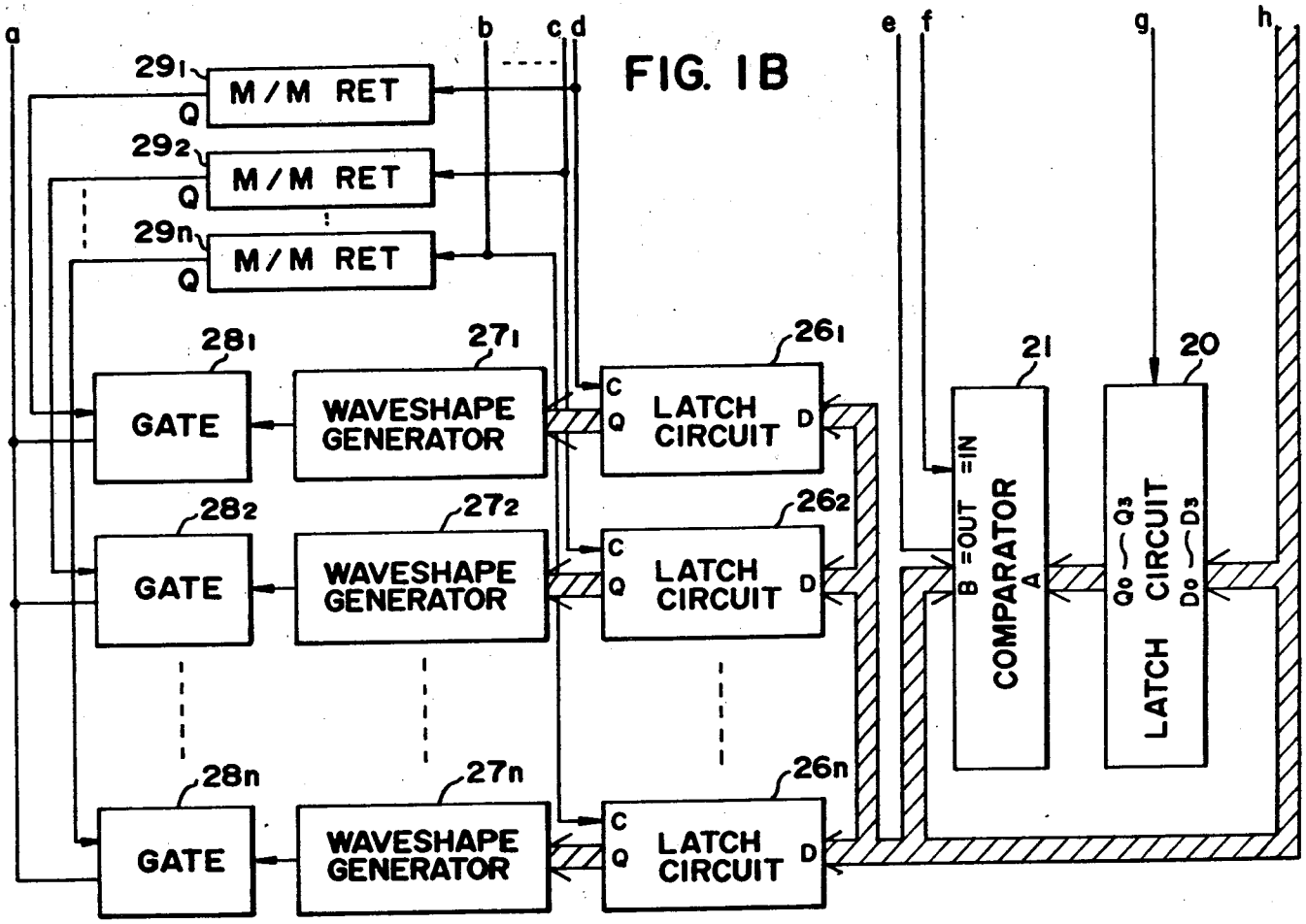

In FIGS. 1A and 1B, a key matrix 9 which comprises key switches connected in a matrix form, is provided as a keyboard circuit, and parallel data which is sequentially incremented is applied to a decoder 10 and a data selector 11 from a Q output of a presettable up/down counter 12 which is reset to its lower limit value for scanning the key matrix 9. The key matrix 9 is scanned by the decoder 10 and key depression data is selected by the data selector 11 and output in the form of serial data from an output terminal Zout.

The presettable up/down counter 12 is driven by clock pulses from a clock generator 13 and is initialized to predetermined lower and upper line values by a reset signal (R) and a preset signal alternately. The presettable up/down counter 12 performs up/down counting in accordance with an up/down signal (U/D). That is, the up/down signal (U/D) is applied to a monostable multivibrator 14 to generate a trigger signal, by which the up/down counter 12 is preset for down counting. The serial data from the output terminal Zout of the data selector 11 is provided via a gate 18 to a presettable down counter 17 which is provided with a preferential low-pitched tone production number setter 16 and. At the same time, the serial data from Zout is applied directly to a presettable down counter 23 which is connected in parallel to the presettable down counter 17 and provided with a maximal tone production number setter 22.

In the presettable down counter 17 the number of preferential low-pitched tones to be produced is preset by synchronizing pulses from a synchronizing pulse generator 15 and is decremented by the serial data from the output terminal Zout of the data selector 11. When the serial data is output to the extent corresponding to the preset number of preferential low-pitched tones to be produced, the presettable down counter 17 provides an output from its output terminal Cout to an S input of an R/S flip-flop 19 to invert its Q output. At the same time, the output from the output Cout is applied as a latch signal, over connection g in FIG. 1A, to a latch circuit 20 connected to g in FIG. 1B to latch therein the corresponding parallel data ($D_0$ to $D_3$). The output ($Q_0$ to $Q_3$) from the latch circuit 20 is fed to and retained in a comparator 21. The inverted Q output from the R/S flip-flop 19 is applied to the terminal U/D of the presettable up/down counter 12 and, by the inverted Q output from the flip-flop 19, the presettable up/down counter 12 is preset to the upper limit, by which it is altered to its down counting mode. On the other hand, the inverted Q output is provided to an input terminal (=IN) of the comparator 21 (over connection f), permitting it to yield an output from its output terminal (=OUT). Further, the gate 18 is locked.

Incidentally, the serial data from the data selector 11 is applied to the presettable down counter 23 and, if it is within the range of the maximal number of tones allowed, the presettable down counter 23 supplies latch signals from its output terminals $Q_0$ to $Q_3$ via a decoder 24 to latch circuits $\mathbf{26}_l$ to $\mathbf{26}_n$ (connections b, c, d) for the parallel data respectively corresponding to individual keys.

On the other hand, when the presettable up/down counter 12 is put into the down mode, the key matrix 9 is scanned by the decoder 10 as is the case with the aforementioned up mode and serial data is provided from the output terminal Zout of the data selector 11 giving priority to high-pitched tones to be produced. In this case, since the gate 18 is locked, the serial data is applied to the presettable down counter 23 and, if the data is within the range of the maximal number of tones allowed, latch signals are supplied via the decoder 24 to the latch circuits $\mathbf{26}_l$ to $\mathbf{26}_n$ as in the above mentioned case.

When the output tones of the parallel data fed to the comparator 21 in the down mode coincides with the output tones retained therein in the up mode as described above, the comparator 21 provides its output (=OUT) via an OR circuit 25 (connection e) to the presettable up/down counter 12 to reset it to its initial lower limit value, starting the up mode again.

The above is a description of the case where the number of simultaneous key depressions is less than the maximal number of tones allowed to be produced, and since the tones of the keys being simultaneously depressed are all produced, no problems occur. Even if the number of simultaneous tones to be produced exceeds the maximal number of tones allowed, effective processing can be achieved through utilization of the arrangement of the present invention. In this case, the number of tones of the serial data from the output terminal Zout of the data selector 11 coincides with the maximal number of tones allowed which is set in the presettable down counter 23 before their coincidence in the comparator 21. And the presettable down counter 23 provides its output from an output terminal Cout via the OR circuit 25 to the presettable up/down counter 12 to reset it. In this way, those tones to be produced of simultaneously depressed keys which exceed the maximal number of tones allowed are omitted, but the tones allowed thus omitted are limited specifically to middle frequency sound notes (of depressed keys). In the up mode of the presettable up/down counter 12, the low-pitched tones are preferentially produced and, in the down mode, the high-pitched tones are preferentially produced; namely, the middle frequency sound notes (of depressed keys) are omitted by the number of tones which exceeds the maximal number of tones allowed. The omission of such tones are almost unrecognizable by human ears as referred to previously.

Thus, whether the number of simultaneous key depressions is smaller or larger than the maximal number of tones allowed, the parallel data on the key depressions are latched by controlling the serial data in the latch circuits $\mathbf{26}_l$ to $\mathbf{26}_n$, from which data are provided to waveshape generators $\mathbf{27}_l$ to $\mathbf{27}_n$, generating waveshapes. The waveshape generators $\mathbf{27}_l$ to $\mathbf{27}_n$ are each constituted by a combination of a D/A converter and a voltage-controlled oscillator, or a programmable counter or the like. The output from the waveshape generators $\mathbf{27}_l$ to $\mathbf{27}_n$ are applied via gates $\mathbf{28}_l$ to $\mathbf{28}_n$ to a sound system 31 over connection a for reproduction of the generated musical notes through a speaker 311. The gates $\mathbf{28}_l$ to $\mathbf{28}_n$ are controlled by outputs $Q_l$ to $Q_n$ from the decoder 24 via retriggerable monostable multivibrators $\mathbf{29}_l$ to $\mathbf{29}_n$.

The principal part of the present invention is a circuit 40 surrounded by the one-dot chain line, which circuit processes the serial data and yields control circuits for the parallel data system from the presettable up/down counter 12 to the waveshape generators $\mathbf{27}_l$ to $\mathbf{27}_n$. The indispensable constituent features of the principal part are the presettable down counter 17 having set therein the number of preferential low-pitched tones to be generated and the presettable down counter 23 having set therein the maximal number of tones to be generated. With the combined use of these, it is possible to smoothly carry out switching of operation from the up mode to the down mode and the processing for omitting the middle frequency tones when the number of keys being concurrently depressend exceeds the maximal number of tones to be generated. The presettable down counters 17 and 23 are each formed, for example, by CMOS 1416x (x:0B, 1B) (Semiconductor Data Library CMOS, MOTOROLA Semiconductor Products Inc., Vol. 5/Series B, 1976).

Figure 2:
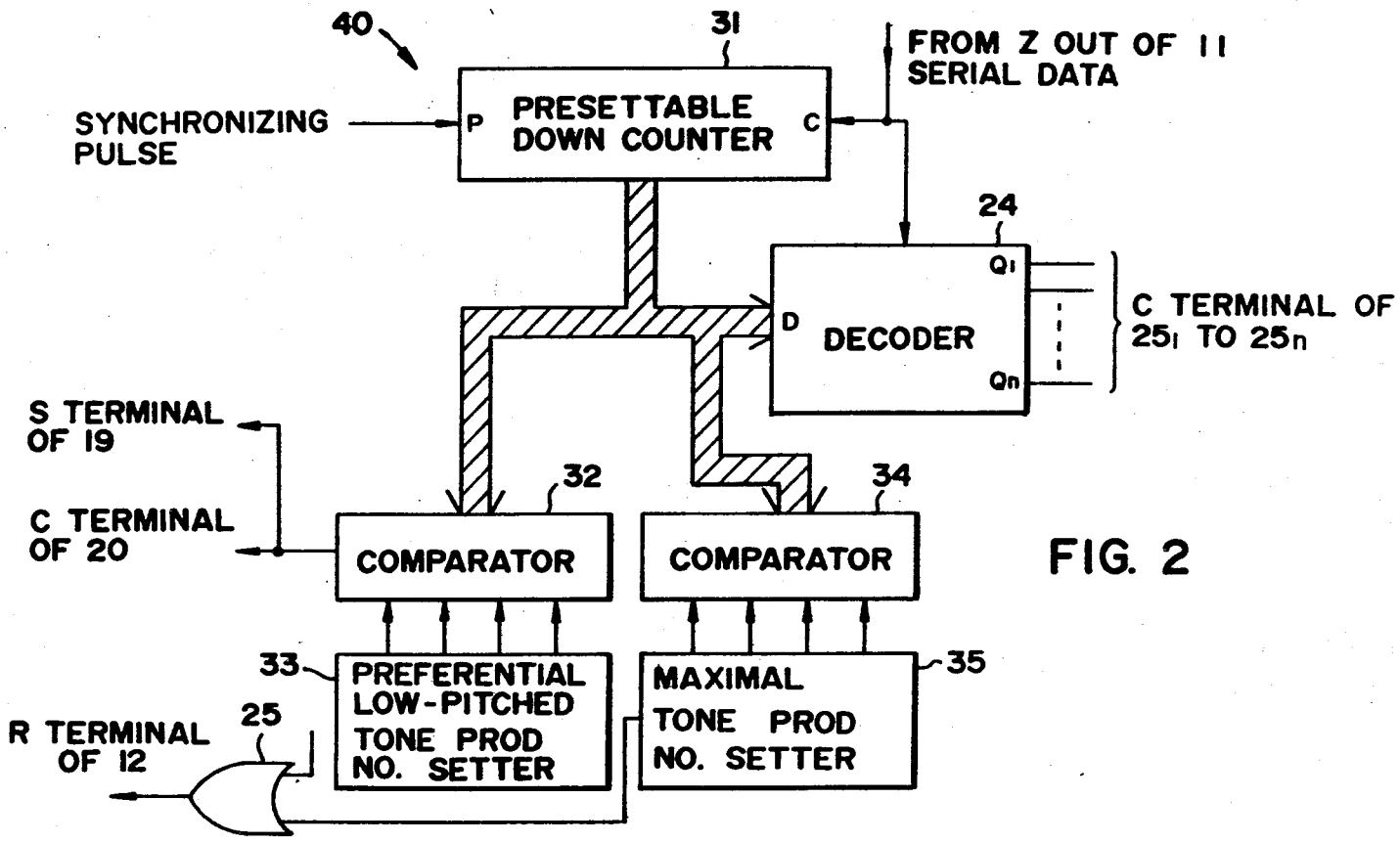
FIG. 2 a block diagram which is explanatory of the arrangement of another embodiment of the principal part of the present invention.

FIG. 2 illustrates a simplified form of the circuit 40 surrounded by the one-dot chain line in FIG. 1A. A common presettable down counter 31 is provided in place of the two presettable down counters 17 and 23 used in FIGS. 1A and 1B. In this case, coincidence is detected by a comparator 32 between the count value of the counter 31 and the content of a preferential low-pitched tone generation number setter 33 first and then coincidence is detected by a comparator 34 between the count value and the content of a maximal tone generation number setter 35. The function of this circuit arrangement is exactly the same as in the case of the embodiment of FIGS. 1A and 1B.

While in the foregoing embodiments the presettable up/down counter (12) is put first in the up mode to preset the number of preferential low-pitched tone productions, it is also possible to start the operation in the down mode to preset the number of preferential high-pitched tones to be produced first.

As has been described in the foregoing, according to the present invention, when the number of simultaneous key depressions are larger than the maximal number of key depressions in a digital keyboard circuit which is restricted in the maximal number of tones allowed, serial data on the key depressions are applied to first means for presetting the number of preferential low-pitched or high-pitched tones to be produced and second means for presetting the maximal number of tones to be produced, supplying control signals for a parallel data system from a presettable up/down counter for scanning the keyboard circuit to a musical waveshape generator. With such an arrangement, low-pitched and high-pitched tones of depressed keys are preferentially produced omitting the intermediate tones of depressed keys; this is not so offensive to the ear and permits smooth processing of an increased number of simultaneous key depressions.

It will be apparent that many modifications and variations may be effected without departing from the scope of the novel concepts of the present invention.

What is claimed is:

1. A key depression number processing system for a keyboard circuit having key switches which are each depressible for selecting a different tone, comprising:

a presettable counter for scanning the key switches to generate key depression data for a number of key switches depressed, said presettable counter receiving a counting-direction signal for presetting a lower limit value and starting counting in one direction from said lower limit value, and for presetting an upper limit value and starting counting in an opposite direction from said upper limit value;

first means connected to said presettable counter for receiving said key depression data and having preset therein a first preset number for preferential low-pitched or high-pitched tones to be produced; and second means connected to said presettable counter for receiving said depression data and having presettable therein a set maximal number of tones to be produced; said first means operating, where said first preset number is for preferential low-pitched tones to be produced and when a number of key depressions in said key data from said presettable counter has reached said first preset number to generate said counting direction signal to reverse the direction of counting of said presettable counter from said upper limit value, to process a number of key switches which are depressed simultaneously; said first means operable where said first preset number is for preferential high-pitched tones to be produced and when a number of key depressions in said data from said presettable counter reaches said first preset number, to generate said counting-direction signal to reverse the direction of counting of said presettable counter from said lower limit, to process a number of key switches which are depressed simultaneously; and said second means operating so that when the number of key switches depressed simultaneously exceeds said preset maximal number, to complete processing only of said preset maximal number of the key switches which are depressed when said preset maximal number of tones produced is reached by said presettable counter, whereby key switches corresponding to medium-pitched tones between said low-pitched tones and said high-pitched tones tend to be excluded from processing.

2. A key depression number processing system for a keyboard circuit according to claim 1, wherein said first means comprises a presettable down counter having preset therein said first preset number of preferential low-pitched or high-pitched tones to be produced, and said second means comprises presettable down counter having preset therein said preset maximal number of tones to be produced.

3. A key depression number processing system for a keyboard circuit according to claim 1, wherein said first and second means are made up of a common presettable down counter and comparators for comparing a count value of said common presettable down counter with said first preset number of preferential low-pitched or high-pitched tones to be produced preset in said first means and said preset maximal number of tones to be produced preset in said second means, respectively.

4. A key depression number processing system for a keyboard circuit according to claim 1, wherein said first means includes a storage circuit and a comparator, a count value of said presettable counter immediately before reversal of its direction of counting being stored by said first means in said storage circuit, said presettable counter performing counting after reversal of its direction of counting, said comparator connected to said presettable counter for detecting when said presettable counter has scanned the key switches to the point of reversal of its direction of counting, which indicates completion of scanning for said key switches.

* * * * *